US007931175B2

(12) United States Patent
Hjort

(10) Patent No.: US 7,931,175 B2
(45) Date of Patent: Apr. 26, 2011

(54) NOZZLE FOR USE IN CONNECTION WITH DOSING OF A MATERIAL FROM A CONTAINER, METHOD AND USE THEREOF

(75) Inventor: Finn Holme Hjort, Ryomgaard (DK)

(73) Assignee: Claus Leonhardt Jensen and Finn Holme Hjort, Hornbaek (DK)

( * ) Notice: Subject to any disclaimer, the term of this patent is extended or adjusted under 35 U.S.C. 154(b) by 679 days.

(21) Appl. No.: 11/574,753

(22) PCT Filed: Sep. 6, 2005

(86) PCT No.: PCT/DK2005/000567

§ 371 (c)(1),
(2), (4) Date: Sep. 20, 2007

(87) PCT Pub. No.: WO2006/026990

PCT Pub. Date: Mar. 16, 2006

(65) Prior Publication Data

US 2008/0264981 A1 Oct. 30, 2008

(30) Foreign Application Priority Data

Sep. 6, 2004 (DK) ..... 2004 01342

(51) Int. Cl.
*B65D 5/72* (2006.01)

(52) U.S. Cl. ..... 222/567; 222/527

(58) Field of Classification Search ..... 222/105, 222/526–533, 556–570, 574
See application file for complete search history.

(56) References Cited

U.S. PATENT DOCUMENTS

| | | | | |
|---|---|---|---|---|
| 1,923,425 | A * | 8/1933 | Diederich | 239/587.5 |
| 3,610,480 | A * | 10/1971 | Lipfert et al. | 222/402.21 |
| 3,910,502 | A | 10/1975 | Mermillod | |
| 6,119,898 | A * | 9/2000 | Dark | 222/153.06 |
| 6,732,958 | B2 * | 5/2004 | Norville et al. | 239/582.1 |
| 6,863,098 | B2 * | 3/2005 | Chrisco et al. | 141/286 |

FOREIGN PATENT DOCUMENTS

| | | |
|---|---|---|
| DE | 3420765 | 12/1985 |
| DE | 19744250 | 4/1999 |
| GB | 2392120 A | 2/2004 |
| WO | WO 2005/065845 A1 | 7/2005 |

* cited by examiner

*Primary Examiner* — Lien T Ngo
(74) *Attorney, Agent, or Firm* — Antonelli, Terry, Stout & Kraus, LLP.

(57) ABSTRACT

A nozzle (1) is disclosed for use in connection with the providing of a fluid material from a container, where the nozzle comprises a first nozzle base part (2), a nozzle tip part and a link (4) connecting the nozzle parts (2, 3). The link (4) has a first pivotal state and a second locked state when the link is under pressure by the material flow The link (4) has a first surface (8) and second surface (10), the surfaces being pivotally connected to each other, and where said surfaces (8, 10) are angled in relation to the longitudinal center axis of the nozzle. The invention also relates to a use of the nozzle (1).

9 Claims, 12 Drawing Sheets

NOZZLE FOR USE IN CONNECTION WITH DOSING OF A MATERIAL FROM A CONTAINER, METHOD AND USE THEREOF

BACKGROUND OF THE INVENTION

1. Field of the Invention

The invention relates to a nozzle for use in connection with dosing of a material from a container.

A use for a nozzle of the above-mentioned kind is in connection with a container such as a cartridge or tube containing filler, silicone, glue or similar materials. The nozzle is the opening for the container and, in connection with the emptying of the container, shall among other things ensure that a suitable amount of the material in the container can be applied in a desired place. The cartridge or the tube often has a built-in nozzle, or is supplied together with the nozzle, which can subsequently be mounted over an opening in the cartridge or the tube.

2. Description of the Prior Art

A cartridge with for example glue, filler or silicone material will often be placed in a caulking or jointing gun, which ensures that the material can easily be pressed out of the cartridge in a uniform stream. A tube or other similar containers can, for example, be emptied manually by pressing on them.

Cartridges or tubes of this kind find application in many places, including in connection with construction sites where, among other things, many places have to be filled or glued.

An important problem in connection with standard containers with nozzles is that the nozzles have a firm conical tube of a certain length, where this considerably limits the working positions which can be assumed by a person using the container. This means that the person must often use extra time in creating the possibility of being able to assume a reasonable working position in relation to the place of work, for example by obtaining a ladder or a scaffold. The alternative for the person will often be to twist the body in an unhealthy working position, such as working with the jointing gun raised high above the head.

The result will often be a less effective execution of the work or a poor quality of work. In the long run, bad working positions will presumably also result in aching muscles and eventual industrial injury.

In order to solve the problem with firm nozzles, it is instead suggested to work with nozzles which have a tip which is flexible in relation to a center axis of the nozzle and the container. With a flexible tip it is possible to create an advantageous working angle for the person who uses the container.

However, nozzles of this type have not gained great application, the reason being that their flexible tips have not proved useful, particularly on building sites where the work tempo is high and the work tools are handled in a correspondingly hard manner. The flexible tips have not been able to tolerate this treatment, whereby the advantageous working angle or the whole of the nozzle has been ruined. The result is that firm nozzles still reign supreme on the market.

SUMMARY OF THE INVENTION

Purpose of the Invention

The invention is a nozzle which is not encumbered with the problems which are described above in connection with the known nozzles within the field, and which is inexpensive to produce. Furthermore, a nozzle in accordance with the invention is flexible and good to use, and at the same time one that it is durable regardless of the kind of treatment to which it is exposed.

The nozzle according to the invention includes a link which has a first pivotal state and a second locked state when the link is under pressure by the material flow, and the link includes a first surface and second surface, the surfaces being pivotally connected to each other, and where the surfaces are angled in relation the longitudinal center axis of the nozzle.

A nozzle of the above type solves the above-mentioned problems. The nozzle can be set at a given angle which is expedient in relation to a working situation, and is locked at this angle that is maintains the position regardless of the material flow.

Appropriately, the nozzle according to the invention is such that the pivot connection between the first surface and the second surface is such that the nozzle tip part may be rotated through 360 degrees in relation to the base part. In other words the nozzle tip part may in the first pivot state be rotated into any position in relation to the base part.

In order to simplify the production of the nozzle according to the invention, it may be advantageous that the surfaces are circular, and that one of the surfaces is provided along an edge with a collar which engages in over the second surface, and that the collar preferably is provided with a number of raised parts or recesses which are distributed evenly around a periphery of the collar.

Appropriately, the nozzle according to the invention may comprise a locking mechanism which can lock the parts to each other in the locked state, the locking mechanism comprising a bolt which is slid in over one of said raised parts or into recesses in the link, which is connected to and slides on a slide rail in one of the parts.

It is also possible to have one or more extra parts which can be slid in between a nozzle base and a nozzle tip. The part or parts will be able to be connected respectively to the nozzle base and the nozzle tip (and possibly each other with further extra parts) by means of a swivel link. The extra parts will possible require further locking mechanisms in order to lock all of the parts to each other, but at the same time will increase the flexibility of the nozzle.

The nozzle according to the invention may furthermore be such provided that the locking mechanism comprises at least one resilient pawl which can engage sideways with the raised parts or down in recesses in the link.

The expression "nozzle base" is to be understood as that part of the nozzle which constitutes the connection to a container containing a material.

The connection between the nozzle base and the container can, for example, be an internal thread in the nozzle, which enables the nozzle to be screwed fast on an external thread on the container. Mechanisms other than threads will also be able to be used for the connection, including the use of glue or tape.

The nozzle base can, however, also be an integral part of the container on which the nozzle tip is subsequently mounted. An example can be a container which is moulded in plastic, and where the nozzle base forms part of the moulding.

In a further aspect, the nozzle base comprises a flange and nozzle tip including a collar with a groove that corresponds in shape with the flange. A nozzle link is provided wherein the material flow forces locking surfaces of the flange and collar against each other. Consequently, the force of the material flow and the friction of the locking surfaces hold the link in a desired position.

In an alternative embodiment, the nozzle according to the invention is such provided that the link comprises a first part and a second part which are mutually movable from the pivotal state to the locked state and vice versa, and that the first part and the second part each have a number of locking surfaces which are engaging with each other in the locked state, as the locking surfaces have a surface with a structure which provides a frictional resistance which is sufficient to lock the surfaces against each other during use.

By this alternative embodiment the nozzle according to the invention may furthermore be such provided that the locking surfaces are parallel surfaces, and that at least one of the locking surfaces in the nozzle tip is facing toward the opening in the nozzle tip toward the exterior.

The nozzle according to the invention has a nozzle base comprising a flange and the nozzle tip comprises a collar with a groove that corresponds in shape with the flange, and the collar comprises a rib surface.

The nozzle according to the invention has the link established in steps of a single moulding process. By way of example, a collar of the nozzle tip is moulded around a flange of the nozzle base establishing the link, as the nozzle base and the nozzle tip are moulded using plastic materials with different melting temperatures, (for example, materials such as PP and PE).

The invention also relates to the use of a nozzle according to the invention in connection with a container in the form of a cartridge or a tube, containing a material in the form of a silicone, a filler, a glue etc.

With another aspect of the invention, the link has a first and second surface, where the surfaces are pivotally connected to each other, and where the surfaces are in angular relationship with the longitudinal center axis of the nozzle. By the angling of the nozzle tip in relation to the longitudinal center axis of the nozzle, it is possible to turn the nozzle tip so that it points in a direction which is not parallel with the center axis of the nozzle.

The expression "center axis" is to be understood such that the axis extends centrally in the nozzle in the longitudinal direction from the start of the nozzle base to the opening in the nozzle tip.

With a further aspect of the invention, the surfaces are circular and one of the surfaces along the edge is provided with a collar which grips over the second surface. It is hereby possible to connect the nozzle parts to each other in a manner which is simple and cheap to produce. This is because the production tolerances on the collar and the surfaces are less critical, merely providing that the collar grips in over the second surface. In connection with the use of the nozzle, the second surface will be pressed out against the collar, whereby a tight closing of the link is established.

The word "collar" is to be understood as an assembly between two nozzle parts, where at least the one part has an edge which grips over the second part. Alternatively, there can be a number of edge sectors on one or both nozzle parts, where these grip in over the second nozzle part in their sectors.

In an alternative embodiment, the link can be created by a protruding part on, for example, the nozzle base, which enters into engagement with a recess in the opposite part, for example, the nozzle tip. In order for the nozzle to function, it will be required that the protruding part has a through-going channel where the material which shall be applied with the nozzle can be fed. With this embodiment of the link, it is possible to create a link which is quick and simple to assemble, but where the production tolerances on the protruding part and recess are important in ensuring that the link doe not separate during use or become leaky.

With a further aspect of the invention, the collar is provided with a number of raised parts or recesses, whereby an advantageous embodiment of the invention is achieved.

The raised parts must be of such shape and cross-section that a locking mechanism (for example a bolt) can gain a secure grip around a recess when it is slid or placed in over the raised part. Correspondingly, the recesses will have such a shape and cross-section that a locking mechanism (for example in the form of a pawl) can be slid in or is placed in a recess without risk of it sliding out.

The raised parts or the recesses can have any configuration whatever, but if these have a substantially triangular or square cross-section towards the bolt, it will be ensured that the bolt is not pressed up over or out of a raised part/recess. At the same time, the collar with the raised parts or recesses will be easy to produce.

With a further aspect of the invention, the raised parts or recesses are evenly distributed over the periphery of the collar. It is hereby possible to place the nozzle tip in a number of positions with a fixed angle between the positions, where the size of the angles can be chosen on the basis of the kind of work for which the nozzle is to be used. In addition to being mutually and evenly distributed, the raised parts or recesses can be assembled in groups which are evenly distributed. An example can be two groups where two raised parts in one group are placed closely together, while there is a distance over to the next group with two closely-placed raised parts. The example can be a nozzle where there is used only for small angles around the center axis of the nozzle.

With a still further aspect of the invention, the locking mechanism comprises at least one bolt which is slid in over one of the raised parts or into recesses in the link. It is hereby possible to have a locking mechanism placed on the side of the nozzle, and slide it sideways in over the raised parts or alternatively into the recesses. With the sideways movement of the locking mechanism, it will be easier to operate the locking mechanism under conditions where, for example, work gloves are worn, than with a pivotal locking mechanism with a part which has to be lifted or swiveled around an axle. Also, it is less likely that the locking mechanism will be jammed or blocked by the sideways movement, and it will be easier to exert extra strength to create a movement.

In an alternative embodiment of the invention, the raised parts or recesses can be placed on/in the nozzle tip instead of on/in a collar, where the bolt placed on the nozzle base can be slid in over the raised parts or into the recesses.

In general, it should be noted that the reversed placing of the raised parts or recesses versus the bolt can naturally also be used. Moreover, the collar can naturally be placed on the surface of the nozzle base instead of the surface of the nozzle tip.

With a further aspect, the locking surfaces have a surface with a structure which provides a frictional resistance which is sufficient to lock the surfaces against each other.

BRIEF DESCRIPTION OF THE DRAWINGS

The invention will now be described with reference to the drawing, where.

DETAILED DESCRIPTION OF THE EMBODIMENTS

Figure 1:
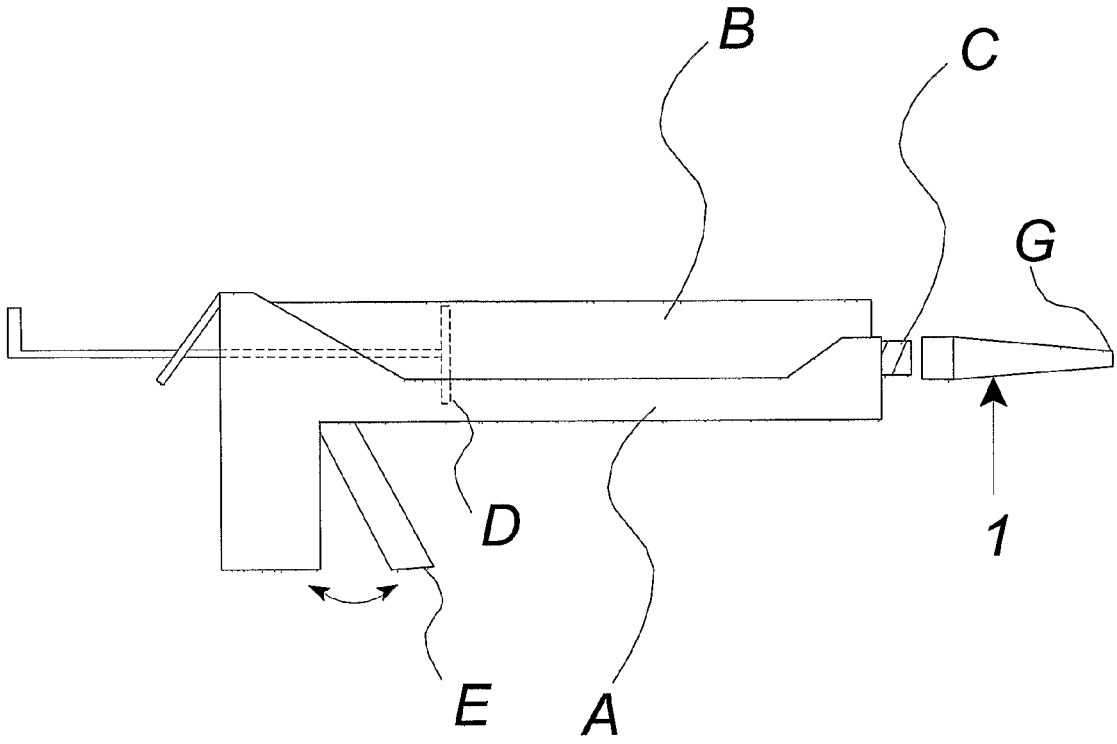
FIG. 1 shows a typical use of nozzle.

FIG. 1 shows a typical application, where a nozzle according to the invention forms part of a standard caulking or jointing gun A which surrounds a container or cartridge B, which, for example, can contain silicone, filler or glue. In order to press the fluid material out of the container, the gun has a plate D which internally is pushed from the one end of the container to the other by movement of a trigger E. The fluid material is pressed out through an opening in the other end of the container, where this end is provided with a conical nozzle 1 which is screwed firmly on an external thread C around the opening in the container.

FIGS. 2-7 show a first embodiment of a nozzle 1 according to the invention.

Figure 2:
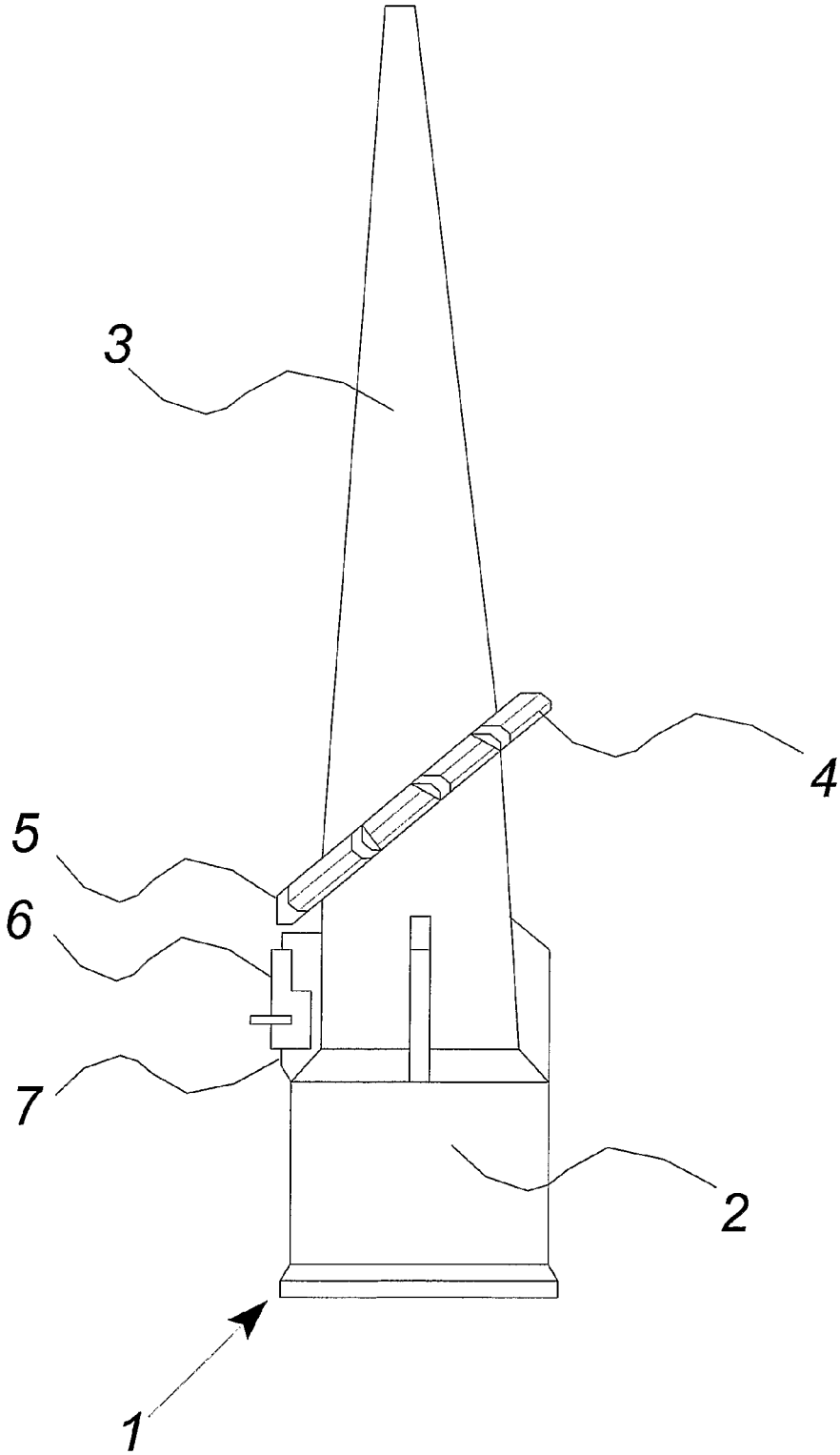
FIG. 2 shows a first embodiment of a nozzle according to the invention.

FIG. 2 shows the nozzle 1 which is made up of two main parts, a nozzle base 2 and a nozzle tip 3, where these are connected to each other via a circular swivel link 4. The swivel link is provided with a number of raised parts 5 which are distributed evenly along the edge of the swivel link.

The nozzle base is provided with a bolt 6 which can be displaced on a slide rail 7 from an unlocked to a locked position, where the bolt in the locked position enters into engagement with one of the raised parts in the swivel link.

In the drawing, the bolt 6 is shown in its unlocked position, where the nozzle tip can be turned to a desired angle in relation to the nozzle base and the longitudinal axis of the nozzle.

Figure 3:
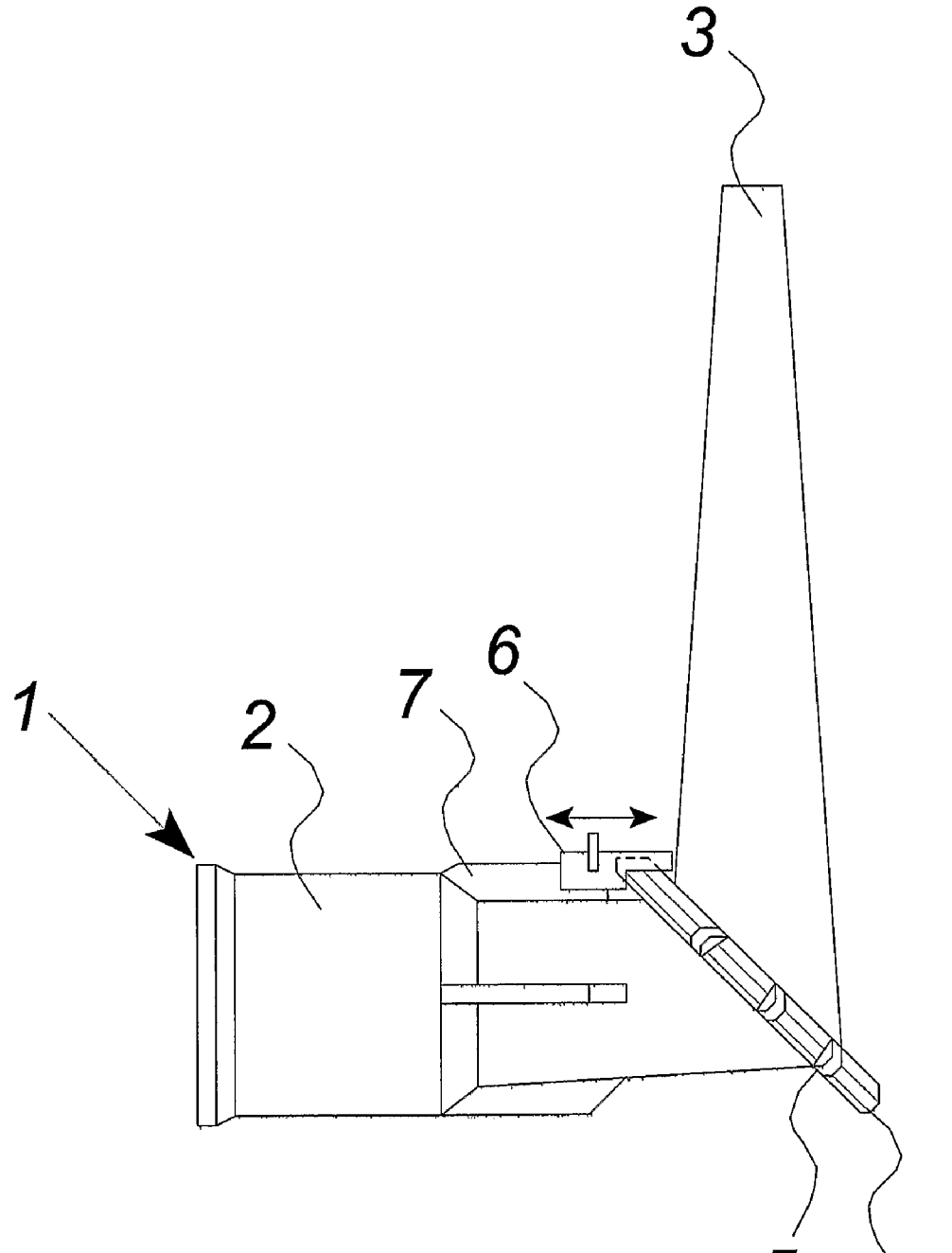
FIG. 3 shows the tip of the nozzle turned to another angle.

FIG. 3 shows the nozzle in a situation, where the nozzle tip 3 has been turned into a desired angle in relation to the nozzle base and the longitudinal axis of the nozzle. After the turning, the bolt 6 is slid forwards so that it engages with one of the raised parts 5 in the swivel link 4, whereby the nozzle tip 3 is locked firmly in relation to the nozzle base 2.

Figure 4A:
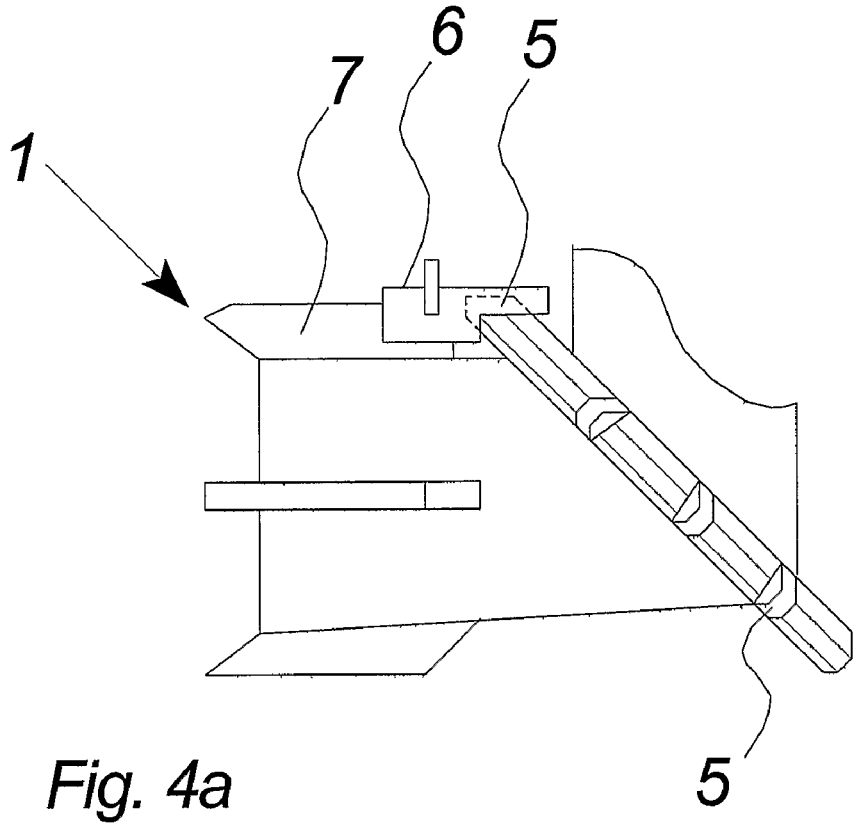
FIG. 4*a* shows a first nozzle locking mechanism in a locked position.
Figure 4B:
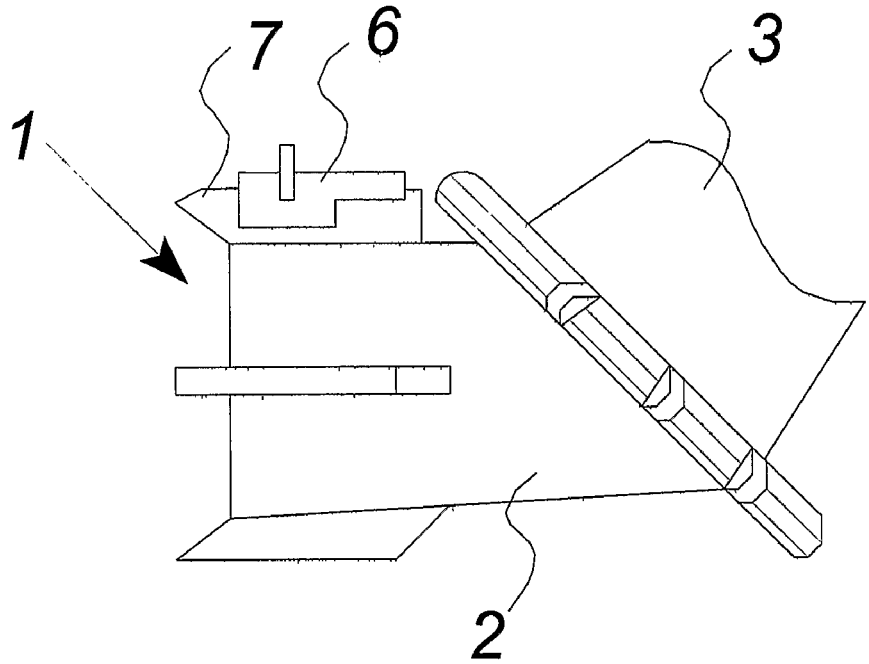
FIG. 4*b* shows the nozzle locking mechanism in an unlocked position.

FIGS. 4*a* and 4*b* show a more detailed section of the nozzle around the swivel link 4, where it is seen how the nozzle tip can be locked fast with the bolt, or alternatively turned when the bolt is not in engagement with one of the raised parts 5 in the swivel link 4.

Figure 5:
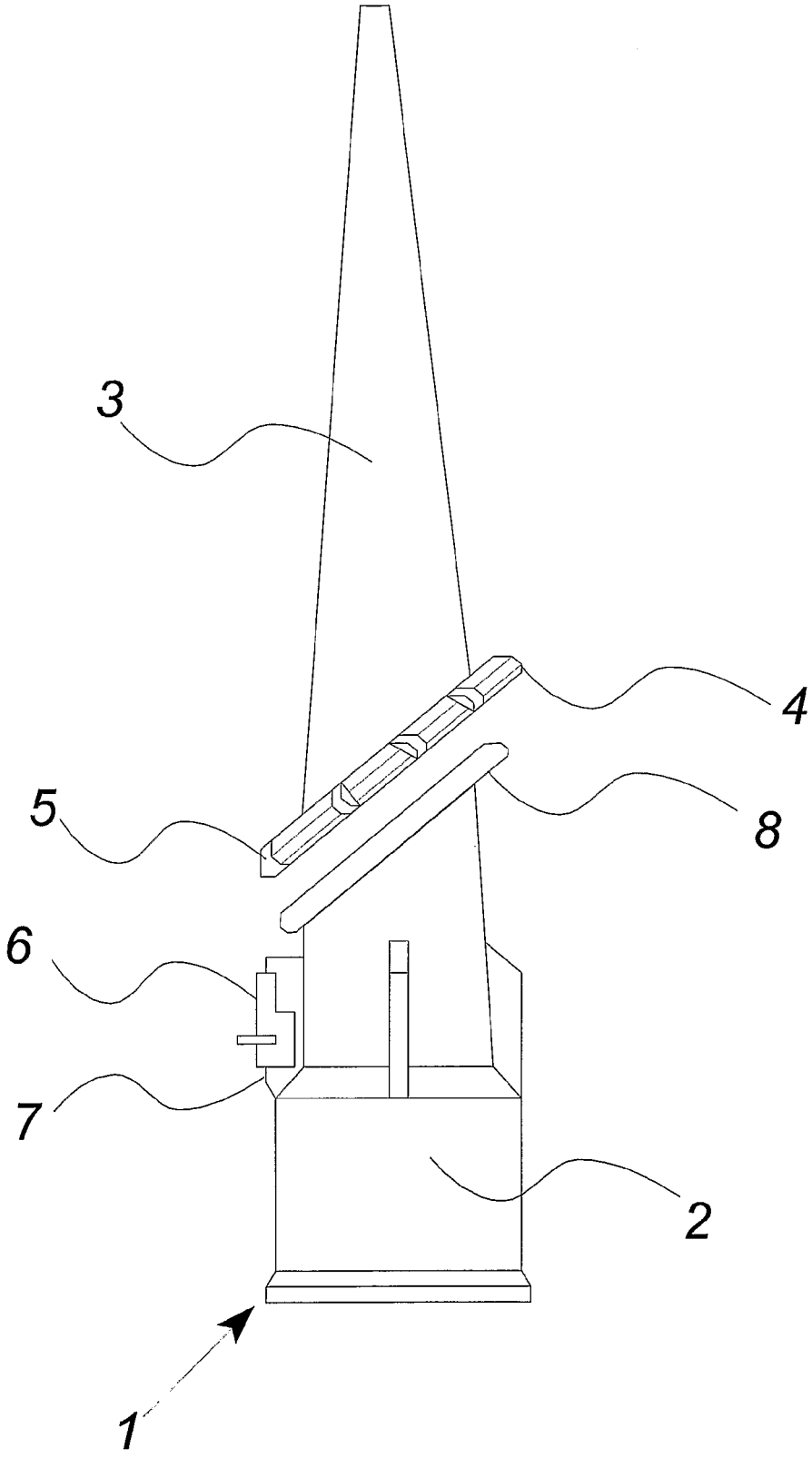
FIG. 5 shows the nozzle in the separated state.

FIG. 5 shows the nozzle separated at the swivel link, for example in connection with the assembly of the nozzle, where the bolt 6 is placed on the slide rail 7, but where the swivel link 4 has not yet been pressed down over the first surface 8. As will appear from the drawing, the diameter of the first surface is less than the diameter of the link, whereby the collar can be pressed in over the first surface.

The bolt 6 is shown with a notch in the side, so that the bolt can be slid in over a raised part 5, but without the whole of the bolt being able to be slid beyond the link 4 since the notch goes against the link. The slide rail is provided uppermost with a horizontal surface which is surrounded by the bolt and on which the bolt slides. The bolt is also provided with a metal plate with which to press the bolt forwards or backwards.

Figure 6:
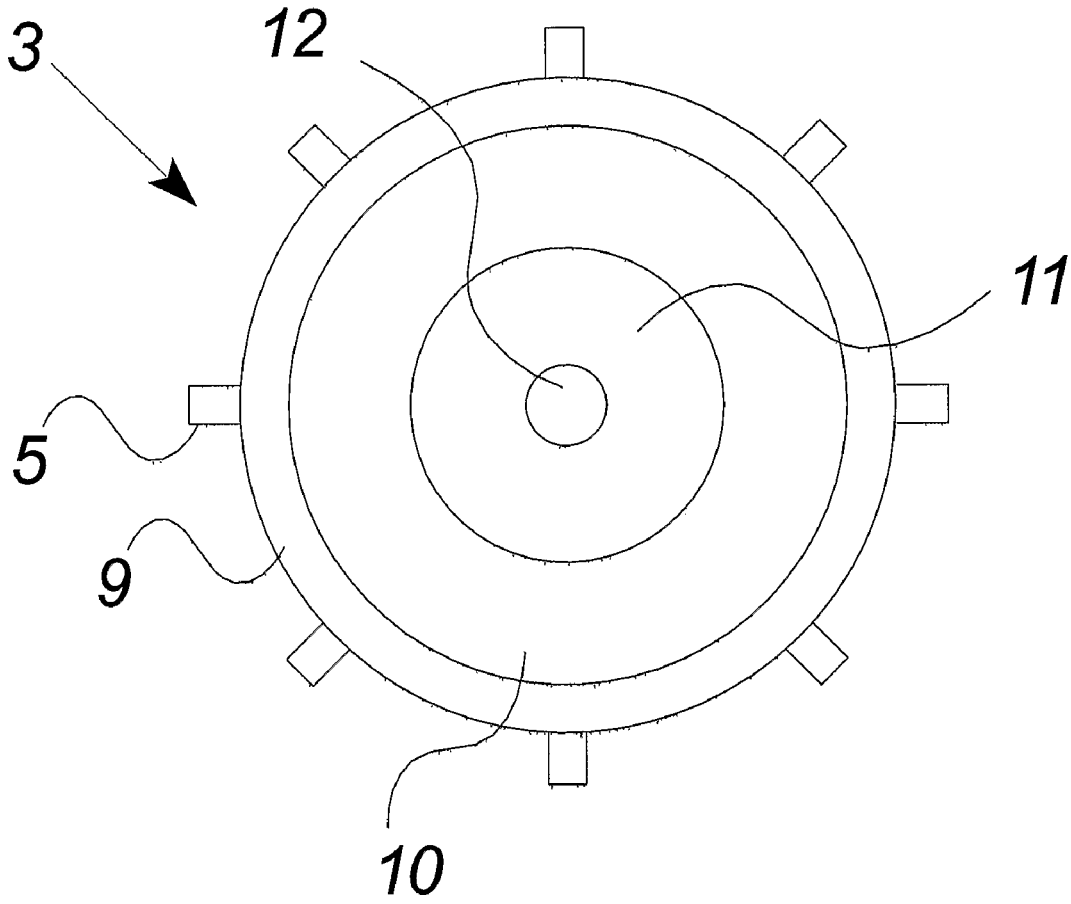
FIG. 6 shows the nozzle tip.

FIG. 6 shows the nozzle tip seen from above and down towards the nozzle opening 12 through the conical interior 11 of the nozzle tip. Also shown is the second surface 10 in the swivel link 4 with the associated collar 9, which is pressed in over the first surface in the nozzle base (not shown in the figure). The first surface has a diameter which is less than the outside diameter of the collar, but greater than the inside diameter of the collar.

The swivel link 4 is also shown with a number of raised parts 5 which are rectangular in cross-section, but where these could also be recesses in the swivel link and be of another cross-section.

Figure 7:
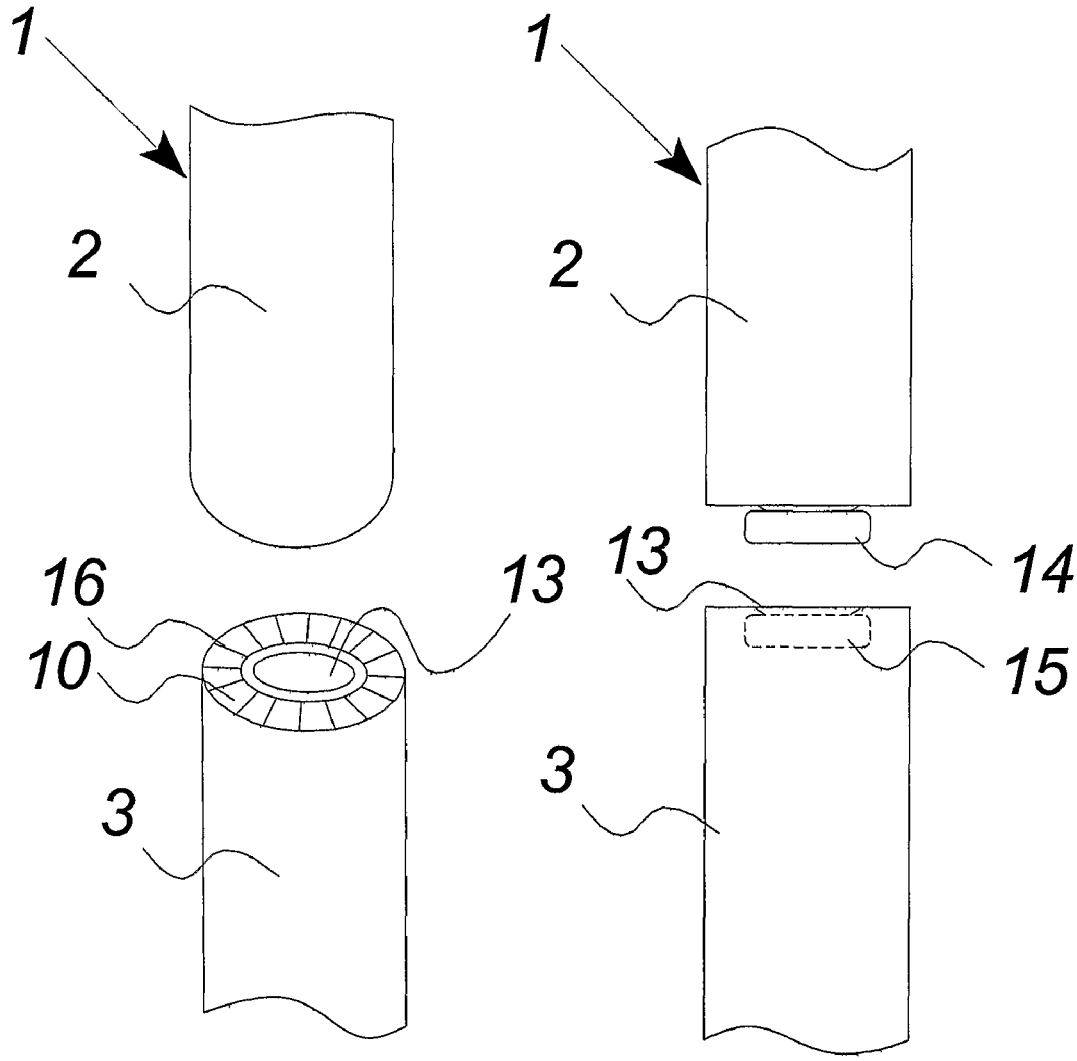
FIG. 7 shows a second nozzle locking mechanism in perspective and from the front.

FIG. 7 shows another method of securing the nozzle tip in a desired position in relation to the nozzle base. The surfaces in the nozzle base and the nozzle tip and are respectively both provided with an uneven surface, for example raised parts which are pressed against each other, whereby the frictional resistance becomes so great that the surfaces maintain their position.

A means by which the surfaces can be held against each other is shown as a link ball, for example for the nozzle tip, which is pressed down through an opening to a recess in the nozzle base, where the recess secures the ball in a pivotal manner.

Figure 8:
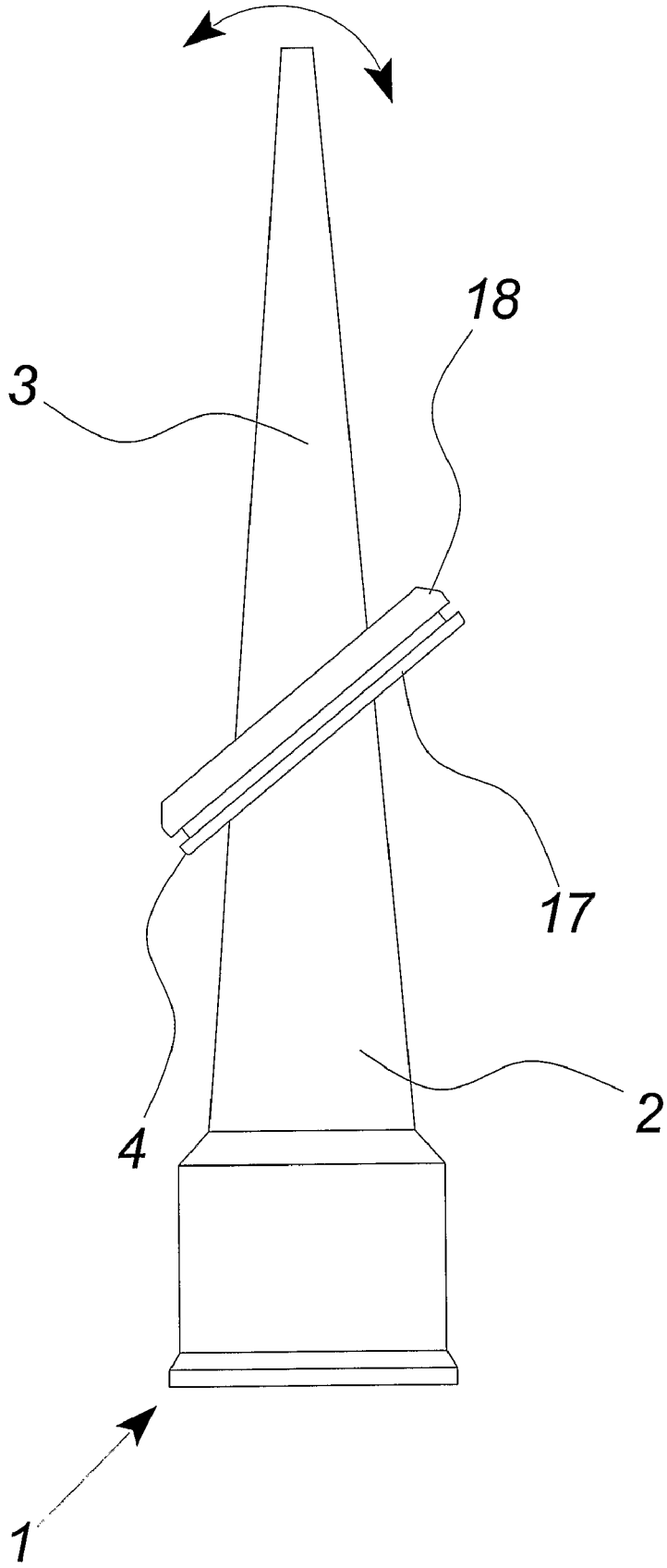
FIG. 8 shows a second embodiment of the nozzle according to the invention, in a state where the nozzle can freely be moved.

FIG. 8 shows the nozzle in a state where the nozzle tip 3 can be moved freely in relation to the nozzle base 2 by turning the link 4. The swivel link 4 is made up of a first part 17 and second part 18, where the first part is secured to the nozzle base 2, while the second part is secured to the nozzle tip 3. The first part 17 also engages with the second part 18 in a manner which permits the parts to be mutually displaced.

The pivotal state for the link 4 is illustrated by the provision of a recess between the first and second part 17, 18.

Figure 9:
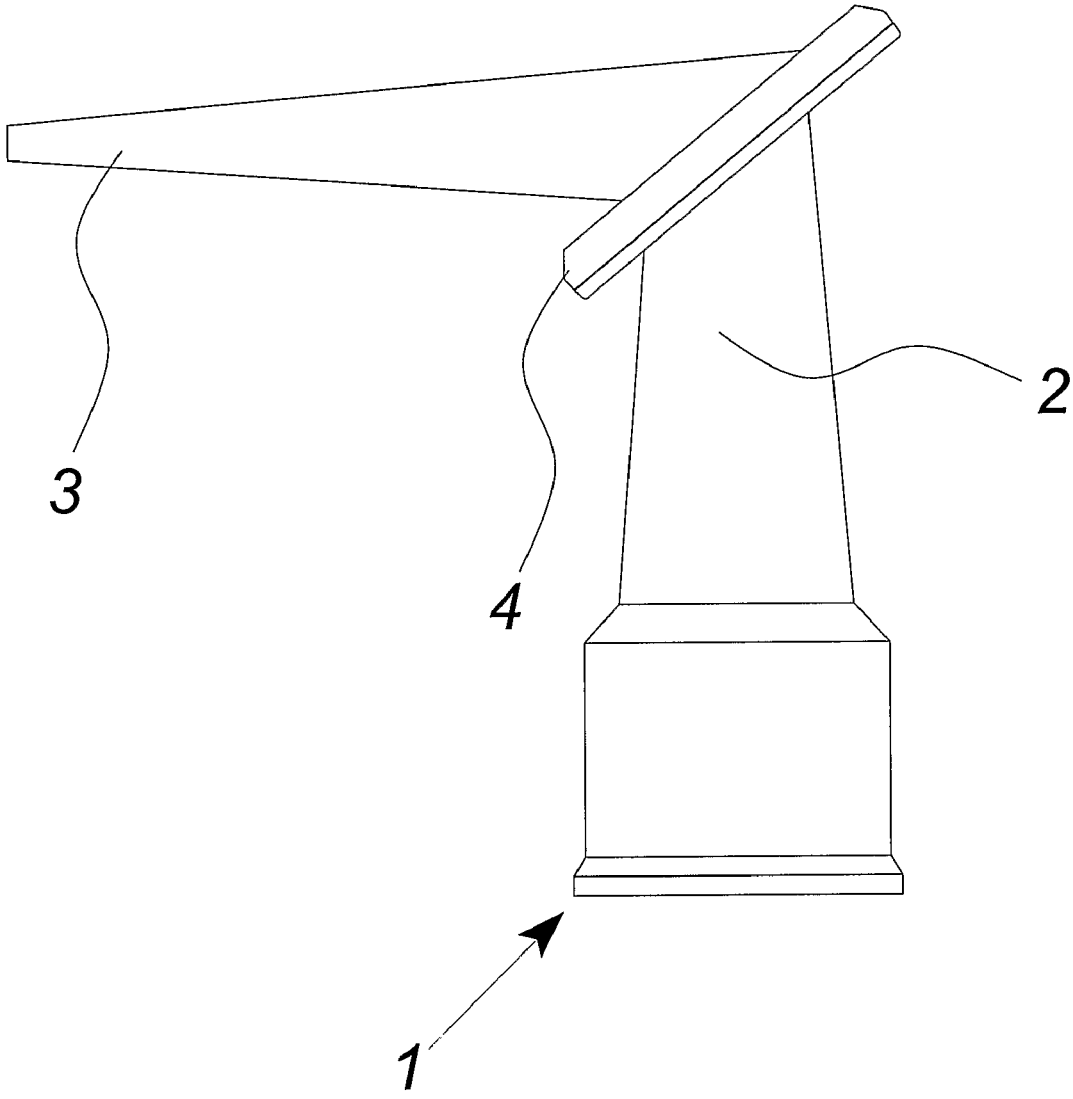
FIG. 9 shows said second embodiment in a locked state.

FIG. 9 shows the second embodiment in a locked state, where the locked state is achieved by pushing the first and second part 17, 18 towards each other. The locked state of the link 4 is therefore illustrated by the fact that the earlier recess between the first and second part 17, 18 is no longer to be found.

Figures 10A, 10B:
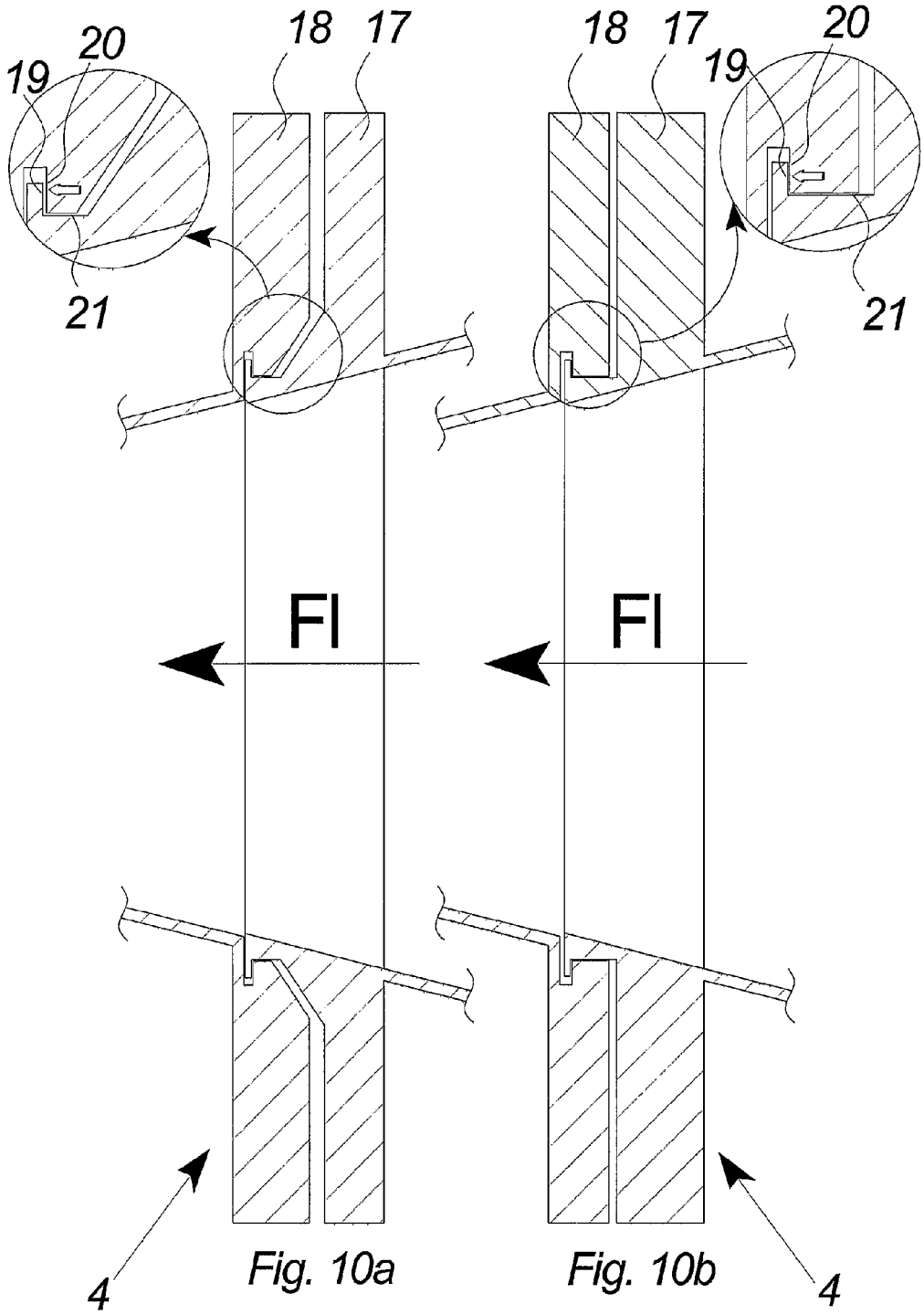
FIGS. 10*a* and 10*b* schematically show cross section views of two different embodiments of a link, including locking surfaces for the second embodiment of the nozzle.

FIGS. 10*a* and 10*b* schematically show two different embodiments of the link 4, including the first and the second part 17, 18 and the associated locking surfaces 19, 20 for the embodiment of the nozzle 1.

FIG. 10*a* shows the two locking surfaces 19, 20, where further surfaces are formed by two conical surfaces, one on each of the first and second part 17, 18. The locking surfaces are placed parallel opposite each other so that these come completely together by movement of the second part 18 in direction with the material flow in the nozzle. The internal flow channel of the nozzle is preferable narrowing toward the exterior opening of the nozzle which ensures a sufficient pressure to hold the first and second part 17, 18 firmly forced against each other in a desired position that is holding the nozzle in a locked state during use.

The parallel edges 21 may establish a further connection between the first and second part 17, 18 and as such help in holding the desired position.

FIG. 10*b* shows the two locking surfaces 19, 20 and the edges 21 formed by surfaces on each of the first and second part 17, 18. The length of the edges is enhanced in this embodiment that is insuring a higher friction between the surfaces.

Furthermore, it will be possible to have additional sets of locking surfaces 19, 20 which come together with, for example the two sets of locking surfaces positioned subsequent each other in direction of the material flow. Further, it will be possible to utilize surfaces in the link other than those shown in FIGS. 10*a* and 10*b*, also including surfaces which although placed opposite each other are not necessarily parallel. One or more of the surfaces can, for example have protruding edges which engage with an opposing plane locking surface.

Figure 11:
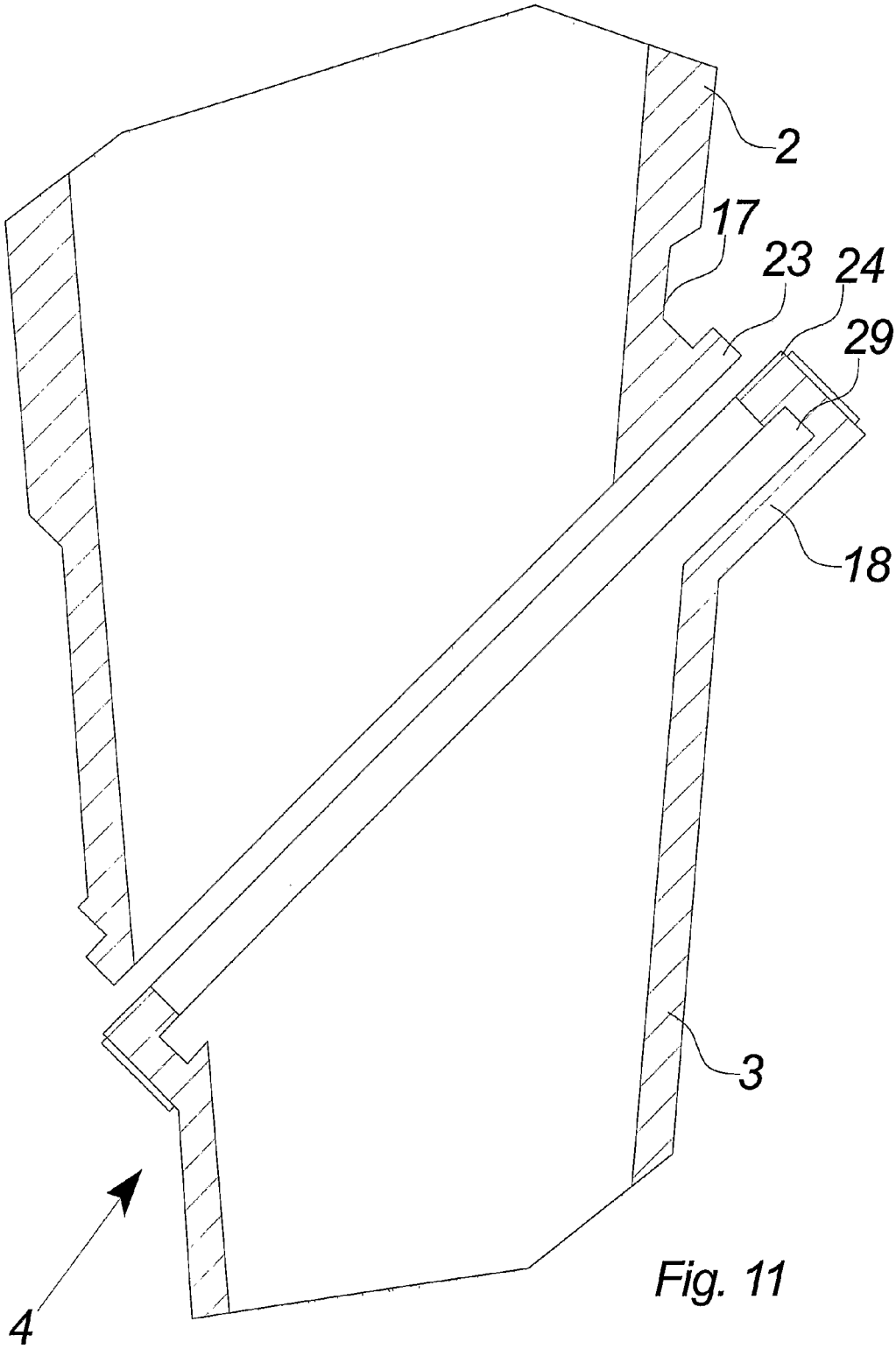
FIG. 11 shows a cross section view of a further embodiment of the nozzle link in a non-assembled state.

FIG. 11 schematically shows a further embodiment of the link 4 in a separated state. The link includes the first and the second part 17, 18 of the nozzle base 2 and nozzle tip 3, respectively.

The first part 17 ends in a flange 23 surrounding the inner opening of the nozzle base in direction toward the tip. The second part 18 ends in a collar 24 surrounding the inner opening of the nozzle tip in direction toward the nozzle base. The collar comprises an inner groove 29 corresponding to the shape of the flange 23.

The flange and groove comprise substantially corresponding rectangular cross sectional shapes. However, the shapes may also be triangular, trapezoidal, quadratic or similar corresponding shapes.

Figure 12:
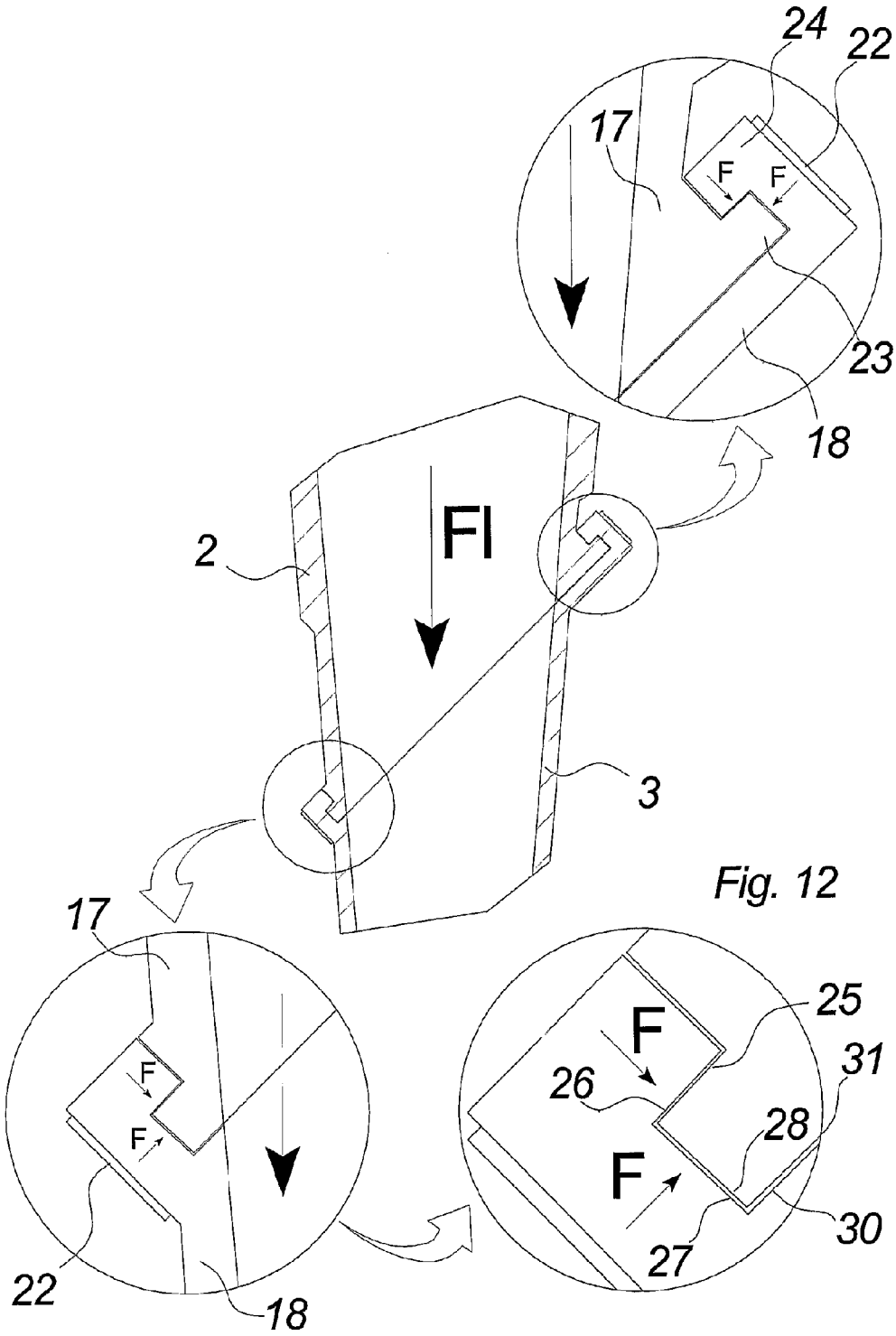
FIG. 12 shows the cross section view of FIG. 11 in an assembled state.

FIG. 12 shows the link embodiment of FIG. 11 in an assembled state wherein the nozzle tip 3 is substantially not angled in relation to the nozzle base 2.

The inner groove 29 of the collar 24 surrounds the flange 23 and hereby is established a tight link 4. The sets of parallel locking surfaces 25-31 are forced against each other when the material is forced to flow in direction toward the opening G of the nozzle tip. The force arrows F illustrate how the nozzle tip is forced in the material direction Fl and especially the locking surface 26 is forced against the parallel locking surface 25 as the locking surface 26 is faced in direction of the opening G.

At any time, at least one of the locking surfaces 26, 27, 30 of the nozzle tip is forced against the corresponding parallel locking surface 25, 28, 31 of the nozzle base by the material flow regardless of the position of the link, that is the angling of the nozzle tip 3 in relation to the nozzle base 2.

The locking surfaces 19, 20, 25-31 can have a structured surface. The structure of the locking surfaces can, for example, include grooves or beads which provide a frictional resistance which is sufficient to lock the surfaces against each other in such a manner that the nozzle maintains its position.

Further, the collar 24 of the nozzle tip may have a rib surface 22 for better gripping and turning the nozzle tip 3 in relation to the nozzle base 2 at the link 4.

The nozzle including the link 4 is preferably formed by plastic moulding in a work process comprising at least two steps such as a two component moulding process. In a first step, the nozzle base 2 is moulded, for example in a plastic injection machine. In a second step, the nozzle tip 3 is moulded in the same mould as the nozzle base where the nozzle base remains in the mould. The link 4 between the nozzle base and tip may hereby be established, for example by subsequently moulding the collar (of the nozzle tip) around the flange (of the nozzle base) in the same mould.

The nozzle base and tip may be in different plastic materials such as PP or PE in order to establish different temperature characteristics, for example, higher and lower melting temperatures. The different materials allow the nozzle base and tip to be subsequently separated in the link 4 by turning one in relation to the other and hereby breaking any weak moulding bond in the link.

Further, the same plastic material may be used but mixed with a separation material such as wax ensuring a separation in the link 4 between the initially moulded nozzle base and later moulded nozzle tip.

Alternatively, one or both the nozzle base and tip may be made in a soft plastic material allowing the flange of the nozzle base to be forced into the groove of the nozzle tip.

The locking surfaces can possibly be additionally prepared for locking by the selection of production material, for example a soft plastic material with high frictional resistance.

The locking surfaces can also be placed outside the link, for example as a part of a sealing jacket which surrounds the link 4.

LIST

1. Nozzle
2. Nozzle base (first part of the nozzle)
3. Nozzle tip (second/further part of the nozzle)
4. Swivel link of the nozzle
5. Raised part
6. Bolt
7. Slide rail
8. First surface
9. Collar
10. Second surface
11. Interior of nozzle tip
12. Nozzle opening
13. Opening down towards recess
14. Protruding part
15. Recess for receiving link ball
16. Grooves (raised parts or recesses in the surface)
17. First part of swivel link (nozzle base)
18. Second part of swivel link (nozzle tip)
19. First locking surface
20. Second locking surface
21. Edges
22. Rib surface for better grip
23. Flange of the nozzle base
24. Collar of the nozzle tip
25, 26. Set of opposite positioned locking surfaces
27, 28. Set of opposite positioned locking surfaces
30, 31 Set of opposite positioned locking surfaces
29. Inner groove of the collar
A. Caulking or jointing gun
B. Container or cartridge
C. Thread
D. Plate
E. Trigger
F. Force as result of material flow through the nozzle
G. Opening in the nozzle tip to discharge material to the exterior
Fl. Flow direction of the material

The invention claimed is:

1. A nozzle for use in connection with providing fluid material from a container, comprising a conical nozzle base, a conical nozzle tip and a link connecting the nozzle base and the nozzle tip wherein the link has a first pivotal state and a second locked state when the link is under pressure from the fluid material, the link includes a first surface and second surface, the surfaces being pivotally connected to each other, the surfaces are angled in relation to a longitudinal center axis of the nozzle, the link provides a flow channel having an internal surface through which the fluid material flows, an end of the nozzle base from which the fluid material flows having a cross section that substantially matches a cross section of an opening of the link that receives the fluid material and an opening of the link from which the fluid material flows into the nozzle tip having a cross section that substantially matches a cross section of an opening of the tip that receives the fluid flow of material, and wherein the surfaces are circular and the first surface is provided along an edge thereof with a collar which engages over the second surface, the collar is provided with raised parts or recesses distributed around a periphery of the collar and the nozzle, the nozzle comprises a locking mechanism which can lock the nozzle base and the nozzle tip to each other in the locked state, the locking mechanism comprising a part which is slid in over one of one of the raised parts or into recesses in the link, which is connected to and slides on a slide rail in one of the nozzle base and nozzle tips.

2. A nozzle according to claim 1, wherein the pivotal connection between the first surface and the second surface permits the nozzle tip to be rotated through 360 degrees in relation to the nozzle base.

3. A nozzle according to claim 1 wherein the raised parts or recesses are evenly distributed around the periphery.

4. A nozzle according to any of the claim 1, wherein the locking mechanism comprises at least one resilient pawl which can engage the raised parts or recesses in the link.

5. A nozzle according to claim 1, wherein the link comprises a first part and a second part which are mutually movable from the first pivotal state to the second locked state and vice versa, and the first part and the second part each have locking surfaces which engage each other in the locked state with the locking surfaces including a surface providing a frictional resistance which is sufficient to lock the locking surfaces against each other during use.

6. A nozzle according to claim 5, wherein the locking surfaces are parallel surfaces, and at least one of the locking surfaces is in the nozzle tip and faces toward an opening in the nozzle tip toward an exterior of the nozzle tip.

7. A nozzle according to claim 1, wherein the nozzle base comprises a flange and the nozzle tip comprises a collar with a groove that corresponds in shape with the flange, and the collar comprises a rib surface.

8. A nozzle according to claim 1, wherein the nozzle tip including the link is formed in steps using a single moulding process by a collar of the nozzle tip being moulded around a flange of the nozzle base establishing the link and the nozzle base and nozzle tip are moulded from plastic materials with different melting temperatures.

9. A use of a nozzle according to claim 1 with a container which is a cartridge or a tube containing the fluid material.

* * * * *